US008556034B2

(12) United States Patent
Rice

(10) Patent No.: US 8,556,034 B2
(45) Date of Patent: Oct. 15, 2013

(54) PAINT CHIP AND DRIP CATCHING LADDER ACCESSORY

(76) Inventor: Christine Rice, Peekskill, NY (US)

( * ) Notice: Subject to any disclaimer, the term of this patent is extended or adjusted under 35 U.S.C. 154(b) by 135 days.

(21) Appl. No.: 13/220,837

(22) Filed: Aug. 30, 2011

(65) Prior Publication Data

US 2012/0061400 A1 Mar. 15, 2012

Related U.S. Application Data

(60) Provisional application No. 61/381,102, filed on Sep. 9, 2010.

(51) Int. Cl.
*E06C 7/00* (2006.01)

(52) U.S. Cl.
USPC ..... 182/129; 248/210; 248/238

(58) Field of Classification Search
USPC ..... 182/129, 116, 120; 248/210, 238; 211/88.02; 220/571
See application file for complete search history.

(56) References Cited

U.S. PATENT DOCUMENTS 1,553,279 A * 9/1925 Wirth ..... 182/122
1,646,509 A * 10/1927 Wais ..... 182/59
2,222,078 A * 11/1940 Kroeger et al. ..... 182/129
2,392,584 A * 1/1946 Falkenstein ..... 182/16
2,570,555 A * 10/1951 Hudoba ..... 211/86.01
2,880,954 A * 4/1959 Frank ..... 248/238
5,120,013 A * 6/1992 Sweeney ..... 248/238
5,899,296 A * 5/1999 Lantz ..... 182/214
2004/0216953 A1* 11/2004 Cheeks ..... 182/116

* cited by examiner

*Primary Examiner* — Alvin Chin Shue
*Assistant Examiner* — Daniel Cahn
(74) *Attorney, Agent, or Firm* — Sinorica, LLC

(57) ABSTRACT

The present invention is a paint chip and drip catching ladder accessory, which is used to prevent stray paint particles from hitting the surrounding area while painting. The present invention comprises a trough and two ladder attachments. The trough is used to catch both wet paint drops and dry paint chips from hitting the ground. The trough is also used to carry the stray paint particles to a wastebasket. Each of the ladder attachments have an insert that can be pushed into the outer side of a ladder, which allows the ladder attachments to be properly positioned along the ladder. The two ladder attachments extend away from the ladder in order to support the trough from the bottom. A plurality of grooves, which is located on the two ladder attachments, allows the trough to be adequately situated on the two ladder attachments.

10 Claims, 3 Drawing Sheets

PAINT CHIP AND DRIP CATCHING LADDER ACCESSORY

The current application claims a priority to the U.S. Provisional Patent application Ser. No. 61/381,102 filed on Sep. 9, 2010.

FIELD OF THE INVENTION

The present invention relates generally to an apparatus for catching paint drips and paint scrapings. More particularly, its objective is to provide a more user-friendly and efficient attachment device to catch paint drips and flakes.

BACKGROUND OF THE INVENTION

To avoid the mess of wet paint hitting the home tiles or driveway pavement, painters typically use a drop cloth or a plurality of drop cloths to prevent paint from staining furniture, carpets, tiles, pavement, etc. But drop cloths have a limit when trying to prevent wet paint from dripping or paint chips from falling into one's garden or flowerbed. Another popular item amateur or even professional painters use to prevent such paint stains are paint drip buckets, lids, or pans. These said items cover a less desirable area of space, making them inefficient and, many times, counterproductive for the painter. It is an object of the present invention to introduce a ladder accessory which allows the painter to efficiently catch paint chips and drips, thereby easily preventing potential stains and paint particles from falling on relevant surfaces, and using the accessory as a means to trap and easily transport scrapings to a wastebasket.

DETAIL DESCRIPTIONS OF THE INVENTION

All illustrations of the drawings are for the purpose of describing selected versions of the present invention and are not intended to limit the scope of the present invention.

Figure 1:
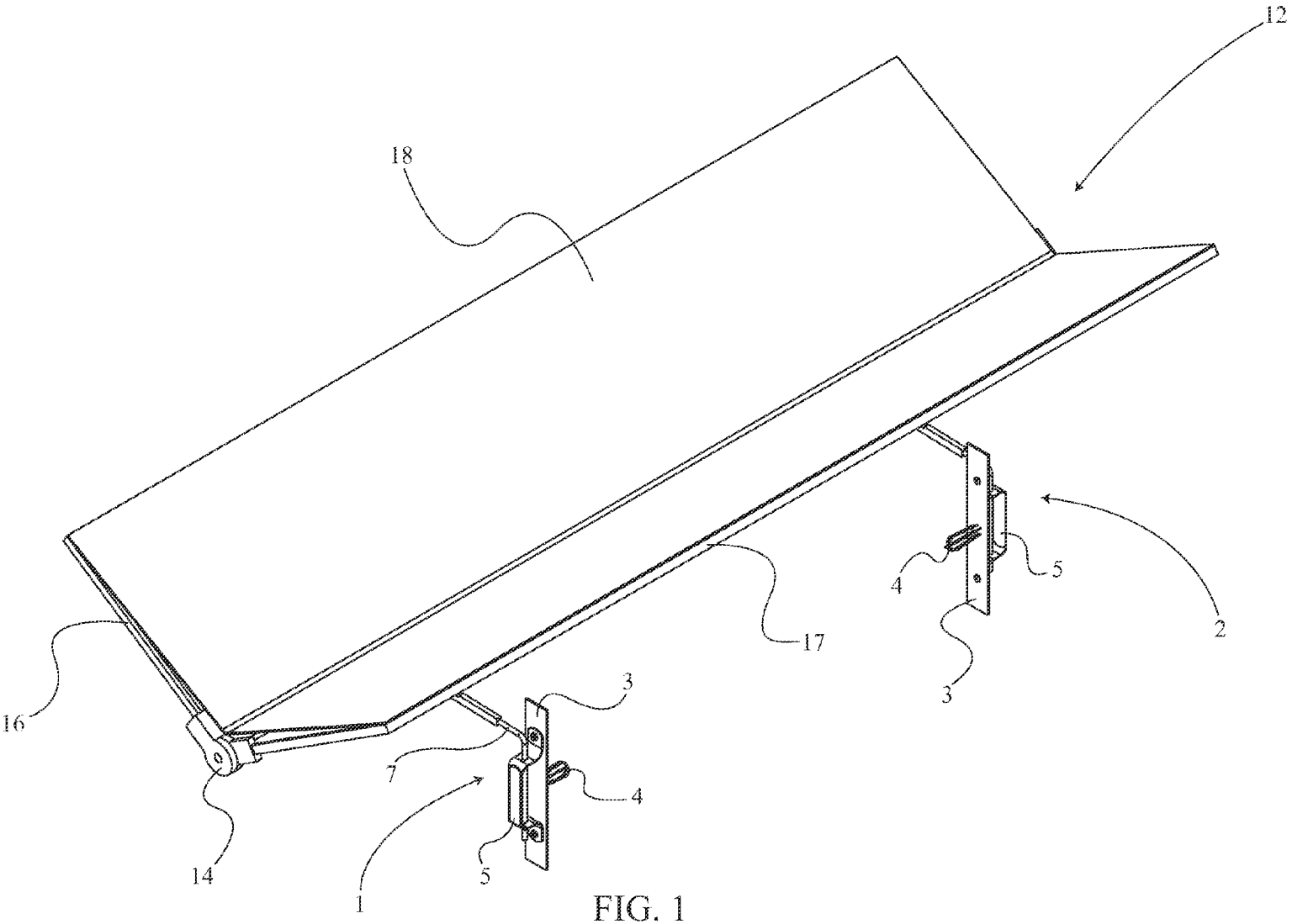
FIG. 1 is a perspective view of the present invention in its entirety.
Figure 2:
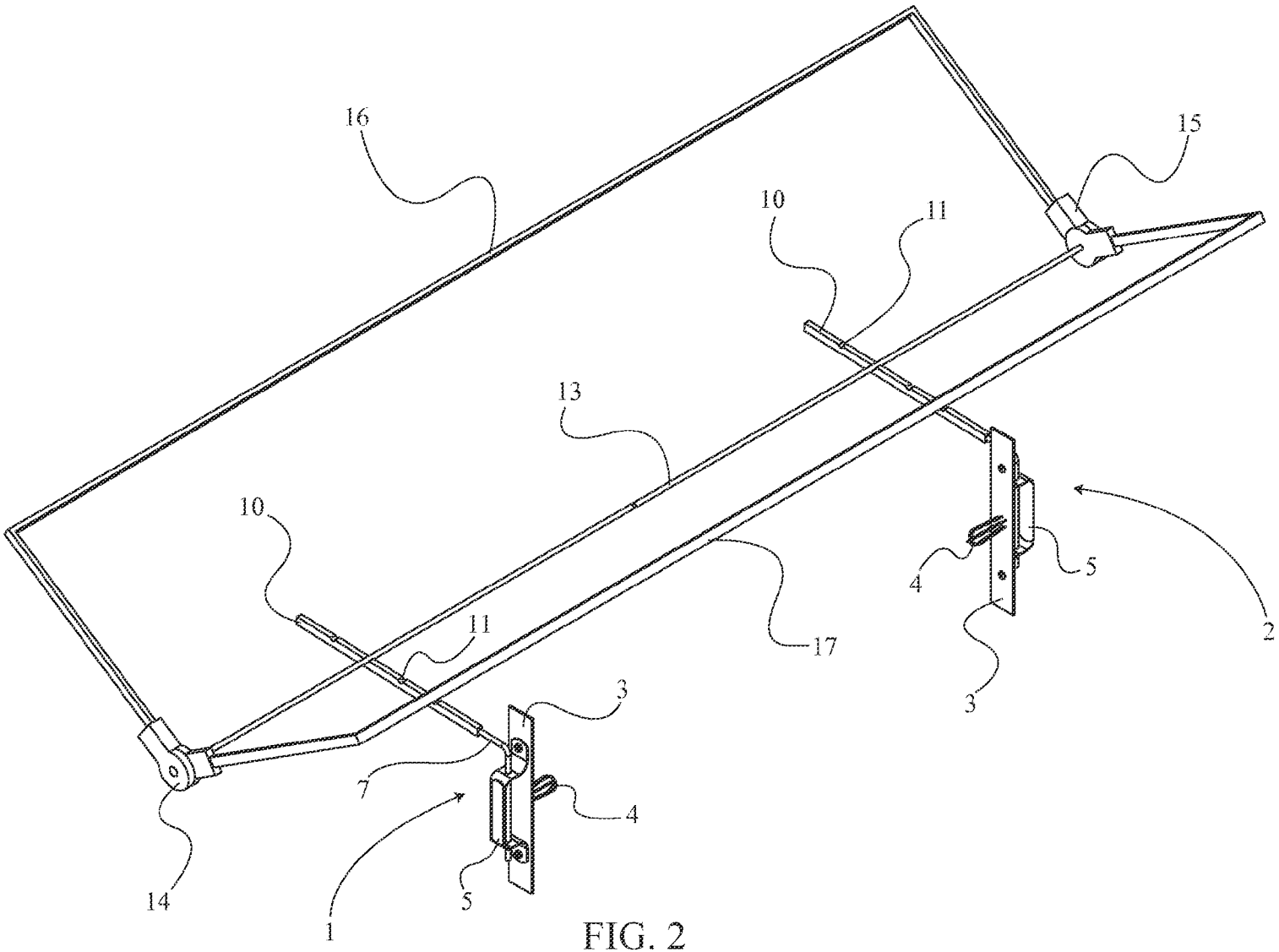
FIG. 2 is a perspective view of the present invention without the fabric.

As can be seen in FIGS. 1 and 2, the present invention is a paint chip and drip catching ladder accessory, which is used while painting on a ladder to prevent a mess of wet paint drops and dry paint chips in the surrounding area. The paint chip and drip catching ladder accessory comprises a left ladder attachment 1, a right ladder attachment 2, and a trough 12. The trough 12 allows the present invention to catch the wet paint drops and dry paint chips before they are able to land in the surrounding area. The trough 12 also allows for easy transport of the paint particles to the trash can. The left ladder attachment 1 and the right ladder attachment 2 support and properly situate the trough 12 along the ladder.

The trough 12 is a long receptacle that is positioned underneath the area being painted. The trough 12 comprises a spine rod 13, a left hinge 14, a right hinge 15, a front frame 16, a back frame 17, and a fabric 18. The front frame 16 is the structure that delineates the front part of the trough 12, and the back frame 17 is the structure that delineates the back part of the trough 12. In the preferred embodiment of the present invention, the front frame 16 and the back frame 17 are staple shaped. The bottom left corner of the front frame 16 is jointly connected to the bottom left corner of the back frame 17 by the left hinge 14. Similarly, the bottom right corner of the front frame 16 is jointly connected to the bottom right corner of the back frame 17 by the right hinge 15. The left hinge 14 and the right hinge 15 allow the front frame 16 and the right frame to rotate about an axis containing both the left hinge 14 and the right hinge 15. The left hinge 14 and the right hinge 15 allows the front frame 16 and the back frame 17 to rotate away from each to make the trough 12 larger or allows the front frame 16 and the back frame 17 to rotate towards each other to make the trough 12 smaller, or to close the trough 12 entirely, to trap the contents of the trough 12. The spine rod 13 is positioned along the axis containing both the left hinge 14 and the right hinge 15 and is connected in between the left hinge 14 and the right hinge 15. The spine rod 13 is the structure that forms the bottom of the trough 12. The front frame 16, the spine rod 13, and the back frame 17 delineates the entire structure of the trough 12, but the fabric 18 actually allows the trough 12 to catch the wet paint drops and the dry paint chips. The fabric 18 is adhered to and stretched across the front frame 16, the spine rod 13, and the back frame 17.

Figure 3:
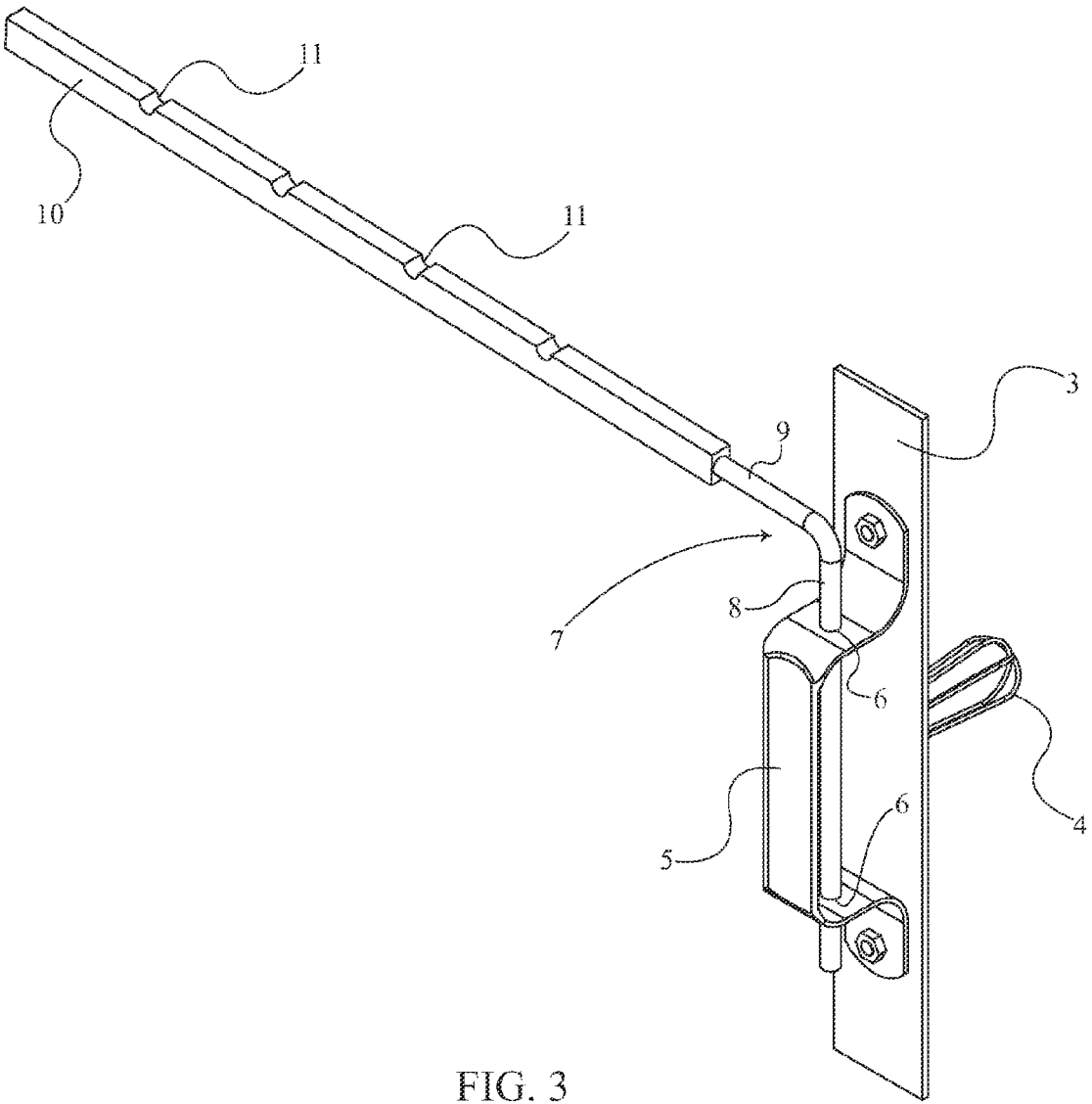
FIG. 3 is a magnified perspective view of the ladder attachment.

To adequately position the trough 12, the front frame 16 rests against the wall that the ladder is leaning on, the back frame 17 rests against the ladder, and the spine rod 13 is supported from the bottom by both the left ladder attachment 1 and the right ladder attachment 2. The left ladder attachment 1 and the right ladder attachment 2 each comprise a ladder panel 3, a ladder insert 4, a handle 5, a pair of rod holes 6, an L-shaped rod 7, an extension arm 10, and a plurality of spine grooves 11. The configuration of either ladder attachment is illustrated in FIG. 3. The ladder panel 3 allows the ladder attachment to brace the outer side the ladder. The ladder insert 4 is connected to one side of the ladder panel 3, and the handle 5 is attached to the other side of the ladder panel 3 by a fastening means. The ladder insert 4 is placed into the side of the ladder to situate the ladder attachment at the proper height and position. An extension ladder is the most common household ladder and usually has a plurality of hollow rungs, which are perpendicularly connected in between a pair of vertical supports. The plurality of hollow rungs will typically traverse through each of the pair of vertical supports and will be exposed on the outer side of the extension ladder. In general, the ladder insert 4 is placed into one of the plurality of hollow rungs in order to situate the ladder attachment. In the preferred embodiment of the present invention, the ladder insert 4 is shaped like a whisk, which sturdy enough to adequately support the ladder attachment on the ladder and flexible enough to easily push the ladder insert 4 into one of plurality of hollow rungs. The handle 5 allows a user to easily grasp the ladder attachment when the ladder insert 4 needs to be placed into the outer side of the ladder or when the ladder insert 4 needs to be pulled out of the outer side of the ladder. In the preferred embodiment of the present invention, the handle 5 is U-shaped, where the ends of the U-shaped handle 5 are attached to the ladder panel 3. The pair of rod holes 6 is located on handle 5 and is concentric with each other. The pair of rod holes 6 is also positioned on opposite ends of the handle 5 adjacent to the ladder panel 3 because the pair of rod holes 6 should not interfere with the user's ability to grasp the handle 5 as the L-shaped rod 7 traverses through the pair of rod holes 6. The L-shaped rod 7 comprises a vertical portion 8 and a horizontal portion 9. The vertical portion 8 is the part of the L-shaped rod 7 that traverses through the pair of rod holes 6. The horizontal portion 9 is perpendicularly connected atop the vertical portion 8 and is used to properly align the extension arm 10. The extension arm 10 is connected to the horizontal portion 9 opposite to the vertical portion 8. The extension arm 10 is used to the support the trough 12 from the bottom by extending away from the ladder attachment and the ladder. In preferred embodiment of the present invention, the extension arm 10 is welded to the horizontal portion 9.

The left ladder attachment 1 and the right ladder attachment 2 work in conjunction to support the trough 12 from the bottom. The extension arm 10 of the left ladder attachment 1 supports the bottom left half of the trough 12. The extension arm 10 of the right ladder attachment 2 supports the bottom right half of the trough 12 and is parallel to the extension arm 10 of the left ladder attachment 1. The plurality of spine grooves 11 is positioned on the extension arm 10. In the preferred embodiment of the present invention, the plurality of spine grooves 11 is semicircular notches filed into the extension arm 10. Each of the plurality of spine grooves 11 on the extension arm 10 of the left ladder attachment 1 has a corresponding spine groove positioned on the extension arm 10 of the right ladder attachment 2. The spine rod 13 is placed into one plurality of spine grooves 11 on the left ladder attachment 1 and the corresponding spine groove on the right ladder attachment 2 in order to prevent the trough 12 from sliding out of place on the left ladder attachment 1 and the right ladder attachment 2.

Although the invention has been explained in relation to its preferred embodiment, it is to be understood that many other possible modifications and variations can be made without departing from the spirit and scope of the invention as hereinafter claimed.

What is claimed is:

1. A paint chip and drip catching ladder accessory comprises, a left ladder attachment;

a right ladder attachment;

a trough;

said left ladder attachment and said right ladder attachment each respectively comprises a ladder panel, a ladder insert, a handle, a pair of rod holes, an L-shaped rod, an extension arm, and a plurality of spine grooves;

said trough comprises a spine rod, a left hinge, a right hinge, a front frame, a back frame, and a fabric;

said L-shaped rods respectively comprise a vertical portion and a horizontal portion;

said front frame being jointly connected to said back frame by said left hinge and said right hinge;

said spine rod being connected in between said left hinge and said right hinge;

said fabric being positioned over said front frame, said spine rod, and said back frame;

said fabric being adhered to said front frame and said back frame; and said plurality of spine grooves of said left ladder attachment and said plurality of spine grooves of said right ladder attachment being engaged by said spine rod.

2. The paint chip and drip catching ladder accessory as claimed in claim 1 comprises, said left ladder attachment being positioned adjacent and below said trough;

said right ladder attachment being positioned adjacent and below said trough opposite said left ladder attachment; and said trough being seated upon said left ladder attachment and said right ladder attachment.

3. The paint chip and drip catching ladder accessory as claimed in claim 1 comprises, said ladder insert of said left ladder attachment being centrally connected on said ladder panel of said left ladder attachment; said handle of said left ladder attachment being attached onto said ladder panel of said left ladder attachment opposite said ladder insert of said left ladder attachment; said pair of rod holes of said left ladder attachment being positioned opposite of each other on said handle of said left ladder attachment; said pair of rod holes of said left ladder attachment being positioned concentric to each other; said pair of rod holes of said left ladder attachment being traversed through by said L-shaped rod of said left ladder attachment; said L-shaped rod of said left ladder attachment being connected to said extension arm of said left ladder attachment opposite said pair of rod holes of said left ladder attachment; and said plurality of spine grooves of said left ladder attachment being positioned on said extension arm of said left ladder attachment; said ladder insert of said right ladder attachment being centrally connected on said ladder panel of said right ladder attachment; said handle of said right ladder attachment being attached onto said ladder panel of said right ladder attachment opposite said ladder insert of said right ladder attachment; said pair of rod holes of said right ladder attachment being positioned opposite of each other on said handle of said right ladder attachment; said pair of rod holes of said right ladder attachment being positioned concentric to each other; said pair of rod holes of said right ladder attachment being traversed through by said L-shaped rod of said right ladder attachment; said L-shaped rod of said right ladder attachment being connected to said extension arm of said right ladder attachment opposite said pair of rod holes of said right ladder attachment; and said plurality of spine grooves of said right ladder attachment being positioned on said extension arm of said right ladder attachment.

4. The paint chip and drip catching ladder accessory as claimed in claim 3 comprises, said horizontal portion of said left ladder attachment being perpendicularly connected atop to said vertical portion of said left ladder attachment; said pair of the rod holes of said left ladder attachment being traversed through by said vertical portion of said left ladder attachment; and said extension arm of said left ladder attachment being connected parallel to said horizontal portion of said left ladder attachment opposite of said vertical portion of said left ladder attachment; said horizontal portion of said right ladder attachment being perpendicularly connected atop to said vertical portion of said right ladder attachment; said pair of the rod holes of said right ladder attachment being traversed through by said vertical portion of said right ladder attachment; and said extension arm of said right ladder attachment being connected parallel to said horizontal portion of said right ladder attachment opposite of said vertical portion of said right ladder attachment.

5. The paint chip and drip catching ladder accessory as claimed in claim 3 comprises, said plurality of spine grooves of said left ladder attachment and said plurality of spine grooves of said right ladder attachment being positioned to align with each other.

6. A paint chip and drip catching ladder accessory comprises, a left ladder attachment;

a right ladder attachment;

a trough;

said left ladder attachment and said right ladder attachment each respectively comprises a ladder panel, a ladder insert, a handle, a pair of rod holes, an L-shaped rod, an extension arm, and a plurality of spine grooves;

said trough comprises a spine rod, a left hinge, a right hinge, a front frame, a back frame, and a fabric;

said L-shaped rods respectively comprise a vertical portion and a horizontal portion;

said left ladder attachment being positioned adjacent and below said trough;

said right ladder attachment being positioned adjacent and below said trough opposite said left ladder attachment;

said trough being seated upon said left ladder attachment and said right ladder attachment;

said front frame being jointly connected to said back frame by said left hinge and said right hinge;

said spine rod being connected in between said left hinge and said right hinge;

said fabric being positioned over said front frame, said spine rod, and said back frame;

said fabric being adhered to said front frame and said back frame; and said plurality of spine grooves of said left ladder attachment and said plurality of spine grooves of said right ladder attachment being engaged by said spine rod.

7. The paint chip and drip catching ladder accessory as claimed in claim 6 comprises, said ladder insert of said left ladder attachment being centrally connected on said ladder panel of said left ladder attachment; said handle of said left ladder attachment being attached onto said ladder panel of said left ladder attachment opposite said ladder insert of said left ladder attachment; said pair of rod holes of said left ladder attachment being positioned opposite of each other on said handle of said left ladder attachment; said pair of rod holes of said left ladder attachment being positioned concentric to each other; said pair of rod holes of said left ladder attachment being traversed through by said L-shaped rod of said left ladder attachment; said L-shaped rod of said left ladder attachment being connected to said extension arm of said left ladder attachment opposite said pair of rod holes of said left ladder attachment; and said plurality of spine grooves of said left ladder attachment being positioned on said extension arm of said left ladder attachment; said ladder insert of said right ladder attachment being centrally connected on said ladder panel of said right ladder attachment; said handle of said right ladder attachment being attached onto said ladder panel of said right ladder attachment opposite said ladder insert of said right ladder attachment; said pair of rod holes of said right ladder attachment being positioned opposite of each other on said handle of said right ladder attachment; said pair of rod holes of said right ladder attachment being positioned concentric to each other; said pair of rod holes of said right ladder attachment being traversed through by said L-shaped rod of said right ladder attachment; said L-shaped rod of said right ladder attachment being connected to said extension arm of said right ladder attachment opposite said pair of rod holes of said right ladder attachment; and said plurality of spine grooves of said right ladder attachment being positioned on said extension arm of said right ladder attachment;

and said plurality of spine grooves of said left ladder attachment and said plurality of spine grooves of said right ladder attachment being positioned to align with each other.

8. The paint chip and drip catching ladder accessory as claimed in claim 7 comprises, said horizontal portion of said left ladder attachment being perpendicularly connected atop to said vertical portion of said left ladder attachment; said pair of the rod holes of said left ladder attachment being traversed through by said vertical portion of said left ladder attachment; and said extension arm of said left ladder attachment being connected parallel to said horizontal portion of said left ladder attachment opposite of said vertical portion of said left ladder attachment; said horizontal portion of said right ladder attachment being perpendicularly connected atop to said vertical portion of said right ladder attachment; said pair of the rod holes of said right ladder attachment being traversed through by said vertical portion of said right ladder attachment; and said extension arm of said right ladder attachment being connected parallel to said horizontal portion of said right ladder attachment opposite of said vertical portion of said right ladder attachment.

9. A paint chip and drip catching ladder accessory comprises, a left ladder attachment;

a right ladder attachment;

a trough;

said left ladder attachment and said right ladder attachment each respectively comprises a ladder panel, a ladder insert, a handle, a pair of rod holes, an L-shaped rod, an extension arm, and a plurality of spine grooves;

said trough comprises a spine rod, a left hinge, a right hinge, a front frame, a back frame, and a fabric;

said L-shaped rods respectively comprise a vertical portion and a horizontal portion;

said left ladder attachment being positioned adjacent and below said trough;

said right ladder attachment being positioned adjacent and below said trough opposite said left ladder attachment;

said trough being seated upon said left ladder attachment and said right ladder attachment;

said ladder insert of said left ladder attachment being centrally connected on said ladder panel of said left ladder attachment; said handle of said left ladder attachment being attached onto said ladder panel of said left ladder attachment opposite said ladder insert of said left ladder attachment; said pair of rod holes of said left ladder attachment being positioned opposite of each other on said handle of said left ladder attachment; said pair of rod holes of said left ladder attachment being positioned concentric to each other; said pair of rod holes of said left ladder attachment being traversed through by said L-shaped rod of said left ladder attachment; said L-shaped rod of said left ladder attachment being connected to said extension arm of said left ladder attachment opposite said pair of rod holes of said left ladder attachment; and said plurality of spine grooves of said left ladder attachment being positioned on said extension arm of said left ladder attachment; said ladder insert of said right ladder attachment being centrally connected on said ladder panel of said right ladder attachment; said handle of said right ladder attachment being attached onto said ladder panel of said right ladder attachment opposite said ladder insert of said right ladder attachment; said pair of rod holes of said right ladder attachment being positioned opposite of each other on said handle of said right ladder attachment; said pair of rod holes of said right ladder attachment being positioned concentric to each other; said pair of rod holes of said right ladder attachment being traversed through by said L-shaped rod of said right ladder attachment; said L-shaped rod of said right ladder attachment being connected to said extension arm of said right ladder attachment opposite said pair of rod holes of said right ladder attachment; and said plurality of spine grooves of said right ladder attachment being positioned on said extension arm of said right ladder attachment;

said front frame being jointly connected to said back frame by said left hinge and said right hinge;

said spine rod being connected in between said left hinge and said right hinge;

said fabric being positioned over said front frame, said spine rod, and said back frame;

said fabric being adhered to said front frame and said back frame;

said plurality of spine grooves of said left ladder attachment and said plurality of spine grooves of said right ladder attachment being positioned to align with each other; and said plurality of spine grooves of said left ladder attachment and said plurality of spine grooves of said right ladder attachment being engaged by said spine rod.

10. The paint chip and drip catching ladder accessory as claimed in claim 9 comprises, said horizontal portion of said left ladder attachment being perpendicularly connected atop to said vertical portion of said left ladder attachment; said pair of the rod holes of said left ladder attachment being traversed through by said vertical portion of said left ladder attachment; and said extension arm of said left ladder attachment being connected parallel to said horizontal portion of said left ladder attachment opposite of said vertical portion of said left ladder attachment; said horizontal portion of said right ladder attachment being perpendicularly connected atop to said vertical portion of said right ladder attachment; said pair of the rod holes of said right ladder attachment being traversed through by said vertical portion of said right ladder attachment; and said extension arm of said right ladder attachment being connected parallel to said horizontal portion of said right ladder attachment opposite of said vertical portion of said right ladder attachment.

* * * * *